United States Patent [19]

Kettler

[11] Patent Number: 4,589,385

[45] Date of Patent: May 20, 1986

[54] AIR JUMP START SYSTEM

[76] Inventor: Ebert H. Kettler, 4380 Baza, Leonard, Mich. 48038

[21] Appl. No.: 710,712

[22] Filed: Mar. 11, 1985

[51] Int. Cl.[4] ..... F02N 7/00

[52] U.S. Cl. ..... 123/179 F; 60/626

[58] Field of Search ..... 123/179 F; 60/626

[56] References Cited

U.S. PATENT DOCUMENTS 4,235,216 11/1980 Miles ..... 123/179 F

OTHER PUBLICATIONS

Start Master, Power Precision Group, Standard Screw Company, Hartford Division, P.O. Box 1440, Hartford, Conn. 06102.

*Primary Examiner*—Andrew M. Dolinar

*Attorney, Agent, or Firm*—Gerald R. Hershberger

[57] ABSTRACT

My invention relates to an emergency air jump system for use with motor vehicles having an internal combustion engine that is started by an air type starter. This type of engine is usually started, when on the road, by means of air from an air tank charged from an air compressor actuated by the engine when running. When the air from the tank is depleted a stopped engine cannot be started without outside air. My air jump system provides a means of recharging or re-pressurizing the air tank by utilizing the existing air from a tire normally used or carried by the vehicle, thereby obviating the need for road service. The jump start air line has a coupling adapted to be sealingly connected to the existing outside accessible coupling to the air starter tank, an air line connected to the jump coupling at one end and connected to a female air chuck at the other end. The female air chuck is connected to the inflation valve of one of the vehicle tires thereby releasing pressurized air from the tire through the air tank and jump line couplings into the air tank to facilitate re-starting of the engine.

7 Claims, 5 Drawing Figures

AIR JUMP START SYSTEM

My invention relates to systems for starting internal combustion engines more particularly to an air jump starter apparatus for starting diesel engines equipped with air starters.

There are, of course, known apparatus for air starting diesel engines, however, none utilize a vehicle tire to recharge the air tank which operates the air starter that turns the engine over.

Very often the air in the air starter tank is dissipated before the engine starts and if the driver of the vehicle is a considerable distance away from an auxiliary source of air, he must call for assistance to start his vehicle.

It would be possible to carry a motor operated air compressor in the vehicle, however, this is expensive, and the compressors are cumbersome to use.

With the foregoing in mind a primary object of the present invention is to provide a space-saving, lightweight, inexpensive device for emergency starting of motor vehicle internal combustion engines utilizing an air starter for starting the engine.

It is another object of this device to utilize existing components of the engine starting system to assist in starting such engine when the air pressure in the starter air tank is too low to turn over the such engine.

Another object of this invention is to provide an auxiliary air jump start device operably connected to the existing components of the engine starter air system.

As a more specific object, the present invention provides an inexpensive, efficient, apparatus for jump starting an air startable internal combustion engine comprising; an engine starter air tank mounted on the vehicle arranged and adapted to turn over such engine from compressed air in the tank means for introducing air under pressure into said tank including a check valve connected in fluid relationship to said tank, and an air inlet hose coupling connected to said check valve, said check valve biased to allow air flow into the tank but prevent air flow out of the tank. A tire mounted on the vehicle. An auxiliary hose coupling adapted to be connected sealingly to the foregoing hose coupling, a flexible conduit connected at one end thereof, and a coupling sealingly connected to the air inflation valve stem of said tire to compress the valve stem thereof to open said inflation valve thereby allowing compressed air to flow from the tire into the tank.

These and other objects, features, and advantages of the present invention should become apparent from the following description when taken in conjunction with the accompanying drawing, in which.

Figure 1:
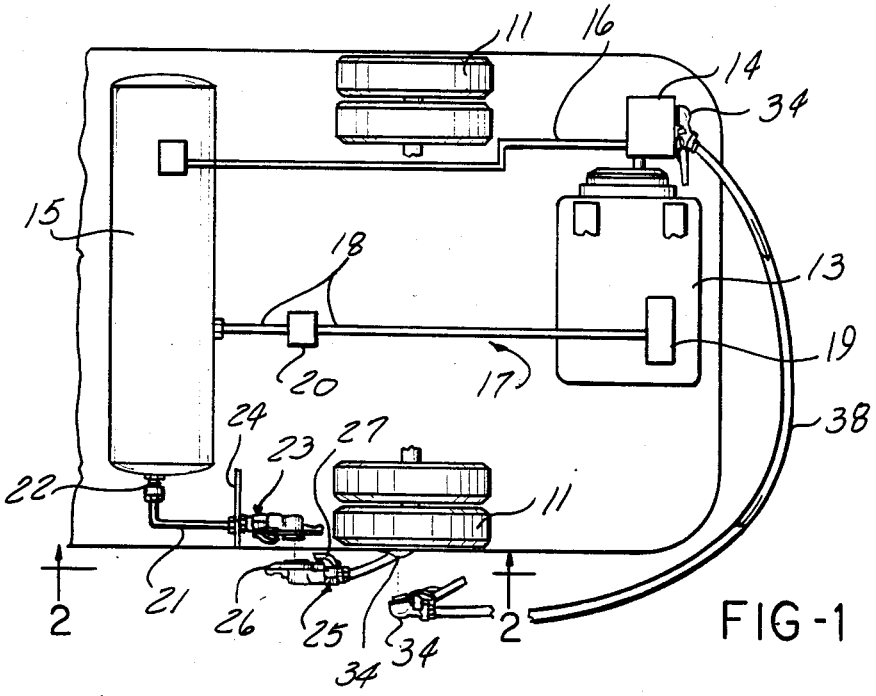
FIG. 1 is a plan view of a portion of a motor vehicle with the jump start system of the invention applied to the engine starting system.
Figure 2:
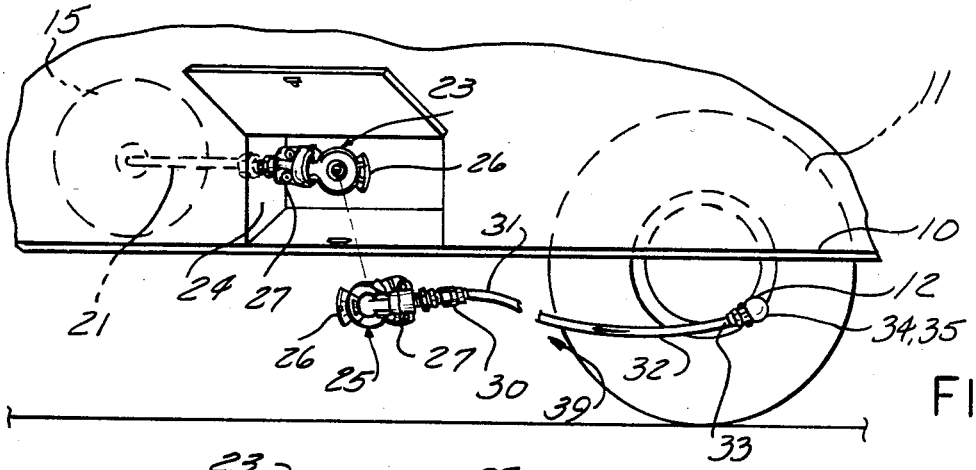
FIG. 2 is a fragmentary elevational view of a motor vehicle disclosing my invention as applied to recharging the air starter tank from a vehicle tire.
Figure 3:
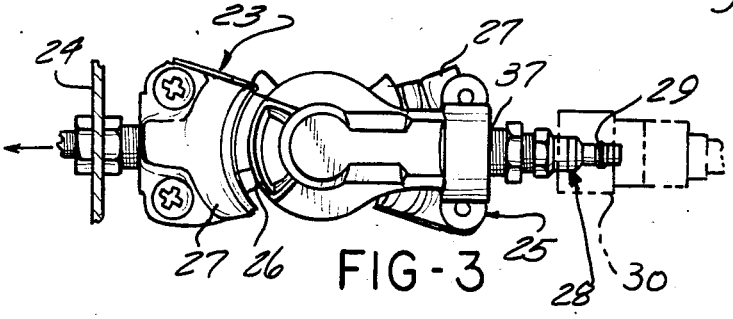
FIG. 3 is a plan view showing the mounting of an air hose coupling to the motor vehicle, and a mating air hose coupling joined to the first coupling and a flexible conduit.
Figure 4:
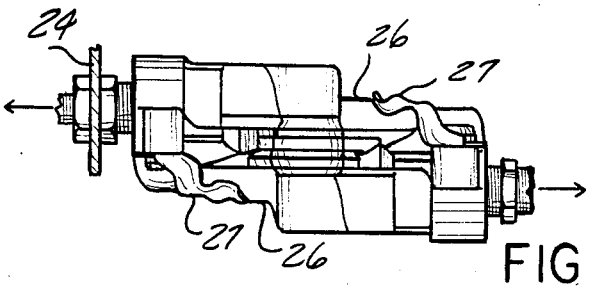
FIG. 4 is a side view of the couplings of FIG. 3 disclosing the method of interlocking the couplings together to seal them.
Figure 5:
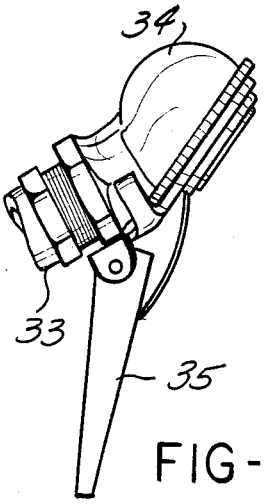
FIG. 5 is an elevational view of a characteristic female air chuck with safety clip.

Referring now to the drawing FIG. 1 and FIG. 2 there is illustrated in broken lines the rear portion of a motor vehicle frame 10, illustrating conventional vehicle parts mounted on said frame including the four rear tires in tandem 11, each having a tire inflating valve 12, the internal combustion engine 13, the air compressor 14, the air starter tank 15, the conventional air input line system 16, from the compressor to the starter tank, a vehicle air starter actuating system 17, connected in engine starting relationship to said engine 13, including an air line 18 connected from the air starter 19 to the tank and a quick opening valve 20 in said line 18 which is adapted to be actuated to release air from the starter tank to said air starter on demand. The air starter tank 15 has an air inlet and outlet system 21 including a known check valve 22 adapted to allow air to be introduced into said tank and biased to prevent air from escaping from said tank and a known quick change large air capacity hose coupling 23, connected to said check valve, is fixedly mounted to a vehicle bulkhead 24 located in the interior of the compartment 36 mounted on vehicle frame 10. In my air jump starter system or apparatus 39, a hose coupling 25, mating or matching hose coupling 23, is adapted to be sealingly connected in fluid conduiting relationship to said tank hose coupling 23, each of said hose couplings having a male member 26 which is rotated into engagement with a female member 27 to clamp the two couplings together in air tight relationship to each other. A known type quick release connector 28 has a male element 29 fixedly connected to the outlet 37 of said coupling 25, and a female element 30 connected to said male element. As is known, the female element is manually retractable to allow the male element 29 to enter therein thereby releasably locking the elements together in air tight relationship to each other. The female element is sealably connected to one end 31 a length of flexible air hose or conduit 32. The other end 33 of said conduit is sealingly connected to a female air chuck 34 having a safety clip 35, which is adapted to be sealingly connected with said tire inflation valve 12 of tire 11. As is known, upon connecting the air chuck 34 with the inflation valve 12, a pin member in the chuck engages the valve system of the inflation valve and depresses the stem so as to allow air to pass in and out of the tire. The safety clip attached to the chuck holds the chuck releasably to the valve, FIG. 3 and 4 disclose the couplings 23 and 25 in larger views to show the construction thereof, and FIG. 5 shows the detail of the air chuck 34.

FIG. 1 further illustrates a system for recharging or pressurizing the air tank 15 from the air compressor 14 after the engine has been started by the tire air. A length of conduit 38 has an air chuck 34 with safety clip 35 connected sealingly to each end thereof. One such chuck is connected to a known air outlet on the compressor 14 and the other end to tire 11. With the engine running the tire is then re-inflated to its former driving tire pressure.

In operation, to recharge the air tank 15 after the air therein has been depleted without the engine 13 starting, the larger jump hose coupling 25 is connected to said air tank coupling as described supra, the line 32 is connected to said coupling 25, and the air chuck 34 is connected to said tire valve 12 thereby releasing pressurized air from said tire into said tank, pressurizing same. When the air in the tank has reached sufficient pressure to turn over the engine, the quick release valve 20 is actuated to turn the engine over to start same. If the air from one tire is insufficient to start the engine, the chuck 34 may be connected to another tire for more pressurized air.

The flexible conduits or tubing are preferably made of light-weight material such as thin walled three eighth inch in diameter polyethylene so as to facilitate the manipulation of my jump start system, and to facilitate coiling thereof and storing in said compartment when not in use.

While I have disclosed one embodiment of the invention it is to be understood that these embodiments are given by example only and not in a limiting sense.

I claim:

1. An apparatus for jump starting the internal combustion engine of a motor vehicle equipped with an air starter comprising in combination:

An engine air pressure starter tank mounted on said motor vehicle;

A tire carried by said vehicle having an inflation valve;

starter tank air inlet means connected in fluid relationship with said tank including a check valve member connected in fluid relationship to said tank, said check valve member normally biased in closed position to prevent air under pressure from discharging from said tank, and operable to be opened to allow pressurized air to enter said tank, and a first air inlet hose coupling connected in closed fluid communication with said check valve member;

and starter tank air recharging means including a second hose coupling sealingly connected releasably in fluid relation to said first hose coupling, a length of flexible tubing connected in sealed air tight relation to said first hose coupling at one end thereof, and a coupling sealingly connected at the other end of said tubing operable to be sealingly connected to the inflation valve of said tire and to compress the valve stem thereof to open said inflation valve to allow pressurized air from said tire to enter said air starter tank through said check valve.

2. The invention according to claim 1 wherein said apparatus further includes an engine air starter operably connected in engine starting relationship with said motor vehicle internal combustion engine, and means for releasing said tire air from said tank in a surge of said air to said air starter to turn over said engine.

3. The invention according to claim 2 wherein said tire air releasing means includes a quick air opening valve between the air tank and the starter.

4. An emergency kit for recharging the air starter tank of a motor vehicle utilizing an air starter to turn over the motor thereof and an air compressor actuated by the motor to initially pressurize the starter tank, said air starter tank having a quick change large air capacity hose coupling sealingly connected thereto, said vehicle having at least one tire having an inflation valve with a valve stem therein, comprising in combination;

A length of flexible conduit;

A first hose coupling adapted to be sealingly connected in air tight relationship to said starter tank hose coupling;

means for sealingly clamping the first hose coupling to one end of said flexible conduit;

a second air coupling connected in air tight relationship to said flexible conduit at its other end and adapted to be sealingly connected to the inflation valve of said tire to depress the valve stem thereof to open the valve to permit the flow of pressurized air from said tire through said second coupling, said flexible conduit, said first coupling and said starter tank coupling into said air tank when said inflation valve is opened.

5. A kit according to claim 4 wherein said second coupling is a female air chuck having a safety clip.

6. A kit according to claim 4 wherein said clamping means includes a quick change connector sealingly connected into said length of conduit adjacent to said second hose coupling.

7. A kit according to claim 4 wherein a second length of flexible conduit is included therein having a female air chuck sealingly connected to each end thereof whereby one end is adapted to be connected to the air compressor and the other end to the inflation valve of the deflated tire to re-inflate the tire after the air from the said tire has been utilized to recharge the starter tank.

* * * * *